US009403390B2

(12) United States Patent
Saiga et al.

(10) Patent No.: US 9,403,390 B2
(45) Date of Patent: Aug. 2, 2016

(54) IMAGE FORMING APPARATUS

(71) Applicants: Soichi Saiga, Tokyo (JP); Shinichiro Naruse, Kanagawa (JP); Kenji Shimizu, Kanagawa (JP)

(72) Inventors: Soichi Saiga, Tokyo (JP); Shinichiro Naruse, Kanagawa (JP); Kenji Shimizu, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/926,168

(22) Filed: Oct. 29, 2015

(65) Prior Publication Data

US 2016/0121634 A1 May 5, 2016

(30) Foreign Application Priority Data

Oct. 31, 2014 (JP) ..... 2014-222638

(51) Int. Cl.
*B41J 25/308* (2006.01)
*B41J 25/304* (2006.01)
*B41J 25/34* (2006.01)
*B41J 25/00* (2006.01)

(52) U.S. Cl.
CPC ..... *B41J 25/001* (2013.01)

(58) Field of Classification Search
CPC ..... B41J 25/001
See application file for complete search history.

(56) References Cited

U.S. PATENT DOCUMENTS 5,000,590 A * 3/1991 Einem ..... B41J 25/3088 400/355
5,692,842 A * 12/1997 Sasai ..... B41J 25/3088 347/37
5,696,541 A * 12/1997 Akahane ..... B41J 25/003 347/8
2003/0107610 A1* 6/2003 Lim ..... B41J 25/304 347/8
2004/0041860 A1* 3/2004 Takahashi ..... B41J 25/3088 347/8
2004/0051754 A1* 3/2004 Lim ..... B41J 2/1752 347/20
2004/0246284 A1* 12/2004 Murai ..... B41J 19/202 347/8
2006/0146106 A1 7/2006 Naruse
2006/0209104 A1 9/2006 Naruse
2006/0268053 A1 11/2006 Naruse
2007/0126787 A1 6/2007 Naruse
2009/0136254 A1 5/2009 Niihara et al.
2009/0136258 A1 5/2009 Naruse et al.
2009/0148181 A1 6/2009 Niihara et al.
2010/0020124 A1* 1/2010 Okazaki ..... B41J 2/16532 347/29
2010/0201743 A1* 8/2010 Miyata ..... B41J 25/3088 347/37
2010/0231643 A1 9/2010 Saiga et al.
2010/0295897 A1 11/2010 Naruse et al.
2011/0134187 A1 6/2011 Naruse et al.

(Continued)

FOREIGN PATENT DOCUMENTS

JP 2012-025041 2/2012

*Primary Examiner* — Stephen Meier
*Assistant Examiner* — Alexander D Shenderov
(74) *Attorney, Agent, or Firm* — Cooper & Dunham LLP

(57) ABSTRACT

An image forming apparatus includes at least one recording head, at least one head holder, a carriage, a reference member, a sub-reference member, and an adjuster. The at least one recording head includes a plurality of nozzles to discharge droplets. The at least one head holder holds the at least one recording head. The carriage holds the at least one head holder and movable in a main scanning direction. The reference member is provided at the carriage and arranged along the main scanning direction. The sub-reference member is provided at the carriage in separation from the reference member. The adjuster adjusts parallelism of the sub-reference member to the reference member. The at least one head holder is supported by and detachable from the reference member, positioned in contact with the sub-reference member, and held in the carriage.

18 Claims, 11 Drawing Sheets

(56) References Cited

U.S. PATENT DOCUMENTS

2011/0134190 A1 6/2011 Mase et al.
2011/0141192 A1 6/2011 Komuro et al.
2011/0199410 A1 8/2011 Mase et al.
2011/0205299 A1 8/2011 Naruse et al.
2011/0216113 A1 9/2011 Yorimoto et al.
2012/0306960 A1* 12/2012 Niihara ..... B41J 2/1752 347/20
2012/0306967 A1* 12/2012 Shimizu ..... B41J 25/34 347/39
2012/0306970 A1 12/2012 Naruse et al.
2013/0070020 A1* 3/2013 Terada ..... B41J 29/38 347/37
2013/0070022 A1 3/2013 Ogawa et al.
2013/0271527 A1 10/2013 Shimizu
2014/0063123 A1 3/2014 Saiga et al.

* cited by examiner

IMAGE FORMING APPARATUS

CROSS-REFERENCE TO RELATED APPLICATION

This patent application is based on and claims priority pursuant to 35 U.S.C. §119(a) to Japanese Patent Application No. 2014-222638, filed on Oct. 31, 2014, in the Japan Patent Office, the entire disclosure of which is hereby incorporated by reference herein.

BACKGROUND

1. Technical Field

Aspects of the present disclosure relate to an image forming apparatus having recording heads.

2. Related Art

Of image forming apparatuses such as printers, facsimiles, copiers, plotters, and multifunction peripherals with a combination of these apparatuses, there is known an inkjet recording apparatus as an image forming apparatus of liquid-ejection recording system using a liquid ejection head (droplet ejection head) to discharge droplets, for example.

In the case of forming an image by the image forming apparatus of liquid ejection system, the landing accuracy of droplets discharged from a nozzle largely influences image quality. The low landing accuracy of droplets degrades image quality, and the recording heads need to be positioned at high accuracy.

Meanwhile, the recording heads need to be easily replaceable under user usage environments in the event of a discharge failure in the recording head. In this case, the reproducibility of positional accuracy needs to be kept high.

SUMMARY

In an aspect of this disclosure, there is provided an image forming apparatus that includes at least one recording head, at least one head holder, a carriage, a reference member, a sub-reference member, and an adjuster. The at least one recording head includes a plurality of nozzles to discharge droplets. The at least one head holder holds the at least one recording head. The carriage holds the at least one head holder and movable in a main scanning direction. The reference member is provided at the carriage and arranged along the main scanning direction. The sub-reference member is provided at the carriage in separation from the reference member. The adjuster adjusts parallelism of the sub-reference member to the reference member. The at least one head holder is supported by and detachable from the reference member, positioned in contact with the sub-reference member, and held in the carriage.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
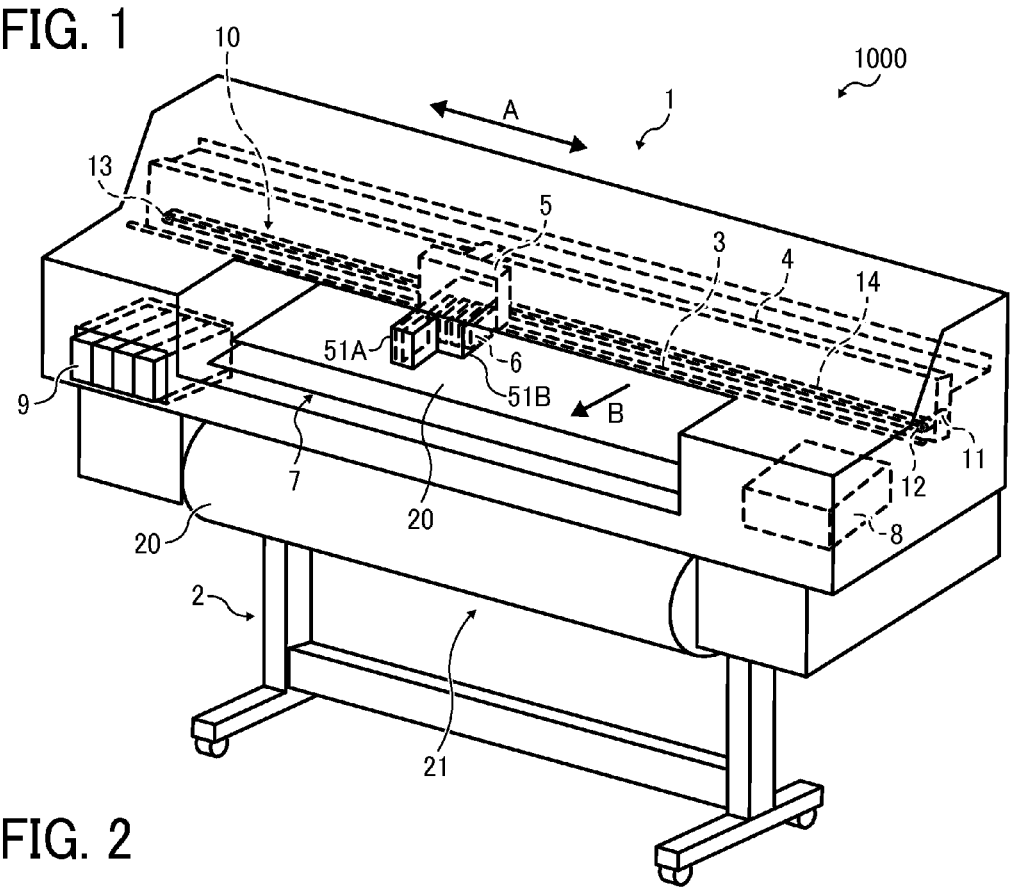
FIG. 1 is an entire configuration diagram of an example of an inkjet recording apparatus as an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Figure 2:
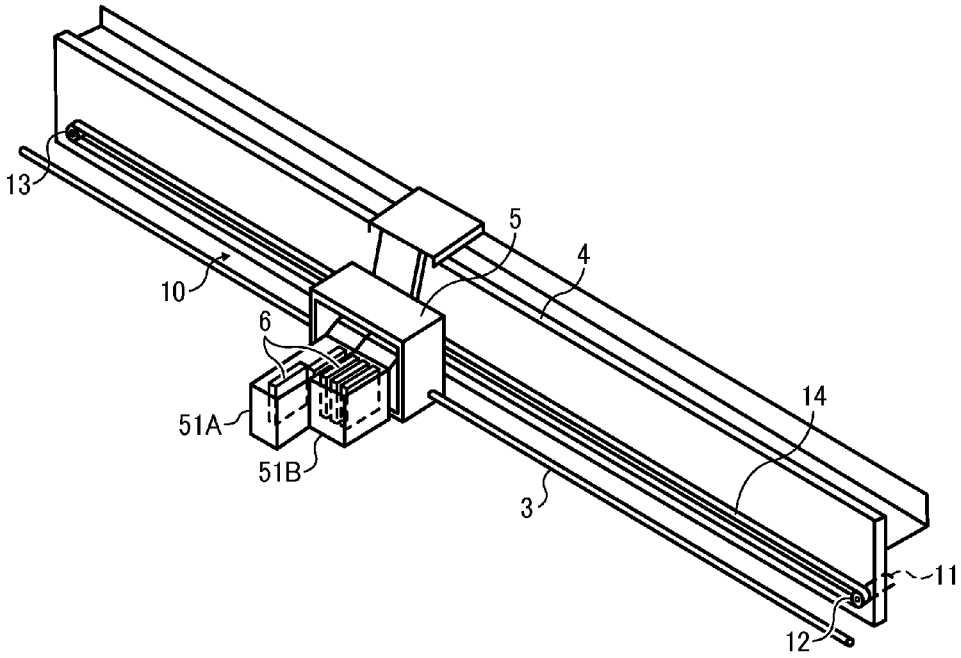
FIG. 2 is a perspective view of a carriage scanning assembly according to the embodiment of the present disclosure.

Embodiments of the present disclosure will be described with respect to the accompanying drawings. FIG. 1 is an entire configuration diagram of an inkjet recording apparatus as an example of an image forming apparatus according to the present disclosure. FIG. 2 is a perspective view of a carriage scanning assembly in the inkjet recording apparatus.

Inside an apparatus body 1 of an inkjet recording apparatus 1000 in this embodiment, a guide rod 3 and a guide stay 4 as guides are hung over both side plates, and a carriage 5 is held by the guide rod 3 and the guide stay 4 to be slidable in directions indicated by arrow A.

The carriage 5 includes recording heads 6 composed of liquid ejection heads to discharge ink droplets of colors of black (K), yellow (Y), magenta (M), and cyan (C). The recording heads 6 have a plurality of nozzles to discharge droplets. The recording heads 6 also include integrally head tanks to supply the inks to the recording heads.

A main scanning assembly 10 moving the carriage 5 for scanning includes: a drive motor 11 disposed at one end in a main scanning direction; a drive pulley 12 rotatable by the drive motor 11; a driven pulley 13 disposed at the other end in the main scanning direction; and a timing belt 14 as a drawing member hung between the drive pulley 12 and the driven pulley 13. The driven pulley 13 is tensioned outward (in a direction away from the drive pulley 12) by a tension spring.

In a main scanning span of the carriage 5, a sheet 20 is intermittently conveyed in a recording span by a suction conveyor 7 in a direction perpendicular to the main scanning direction of the carriage 5 (sub-scanning direction or sheet conveyance direction shown by arrow B).

In addition, at one end side of the main scanning span, a maintenance device 8 is disposed for maintenance of the recording heads 6. At the outside of the carriage movement span in the main scanning direction or the other end of the main scanning span, a main cartridge 9 storing color inks to be supplied to sub tanks of the recording heads 6 is removably mounted to the apparatus body 1.

A roll sheet (hereinafter, referred to as sheet) 20 is set in a sheet feeder 21. Roll sheets with different widths can be set in the sheet feeder 21. The sheet 20 conveyed from the sheet feeder 21 is then conveyed by a conveyor into the recording span from the back to front sides of the apparatus body 1. Then, the carriage 5 is moved in the main scanning direction, the sheet 20 is intermittently fed by the suction conveyor 7, and the recording heads 6 are driven to discharge droplets according to image information, thereby forming a desired image on the sheet 20. Then, the sheet 20 after the image formation is cut into a predetermined length, and is ejected into a sheet ejection tray disposed at the front side of the apparatus body 1.

Figure 3:
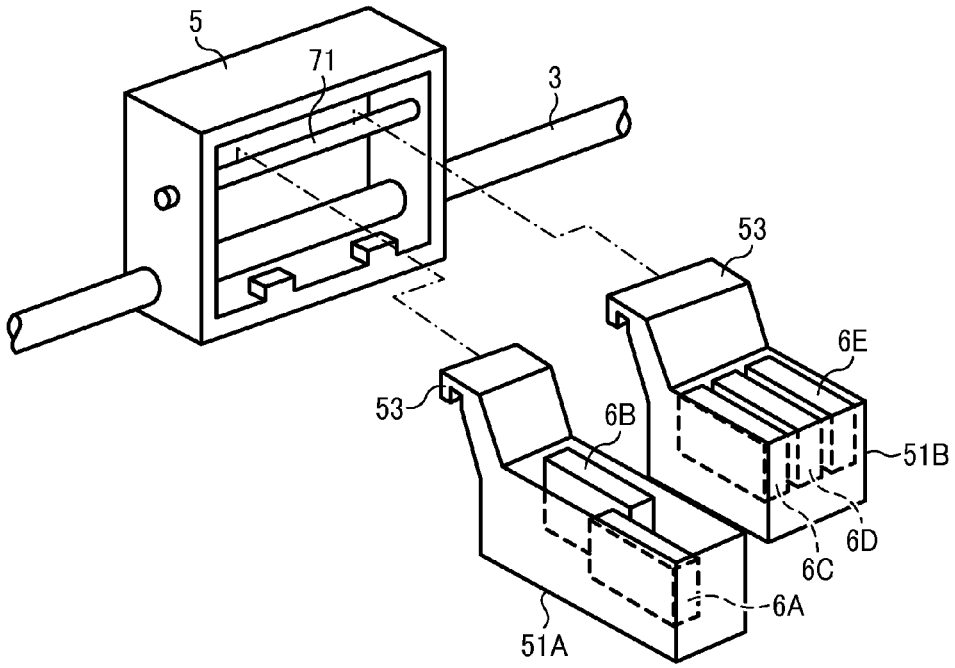
FIG. 3 is a perspective schematic view of the state where head holders are being mounted to a carriage according to the embodiment of the present disclosure.

FIG. 3 is a perspective schematic view of the state where head holders holding recording heads are being mounted to a carriage. As illustrated in FIG. 3, the carriage 5 holds a black head holder 51A and a color head holder 51B.

The head holder 51A includes two recording heads 6A and 6B that are offset from each other in the sub-scanning direction to discharge black droplets. The head holder 51B includes three recording heads 6C, 6D, and 6E that are aligned in the sub-scanning direction to the recording head 6A to discharge yellow, magenta, and cyan droplets. As describe above, the recording heads may be called collectively as recording heads 6 in the case where they do not heed to be differentiated from one another. Each of the head holders 51A and 51B may hold one recording head 6.

The carriage 5 is provided with a reference shaft 71 as a reference member along the guide rod 3. Each of the head holders 51A and 51B (hereinafter, referred to as "head holders 51" in the case where they do not need to be differentiated from each other) are provided with a hook portion 53 to be detachably fitted onto the reference shaft 71. The head holders 51A and 51B are held by the carriage 5 by hitching the hook portions 53 to the reference shaft 71. The reference shaft 71 may be cylinder or polygonal in shape.

As described above, disposing the reference shaft 71 along the guide (guide rod 3) of the carriage 5 improves the positional accuracy of inclination in the sub-scanning direction, the height direction, the tilt direction, and the main scanning direction.

In this embodiment, at the time of replacement of heads, for example, the recording heads 6A and 6B, the head holder 51 is detached from the reference shaft 71, and the replacement head holder 51 is hung and held on the reference shaft 71. Accordingly, the head positional accuracy of the replacement head holder 51 can be reproduced, and the high positional accuracy of the head 6 in the other head holder 51 can be achieved.

Figure 4:
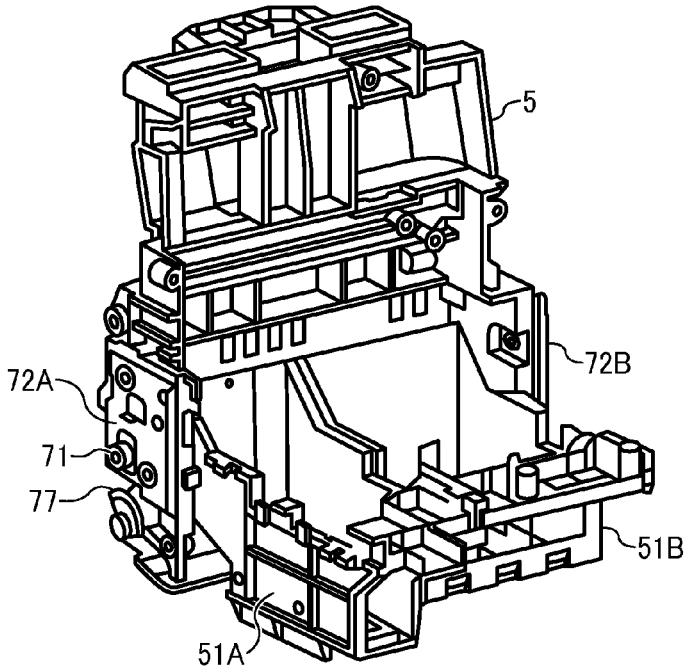
FIG. 4 is a perspective view of the state where the head holders are mounted to the carriage in a specific mode according to the embodiment of the present disclosure.
Figure 5:
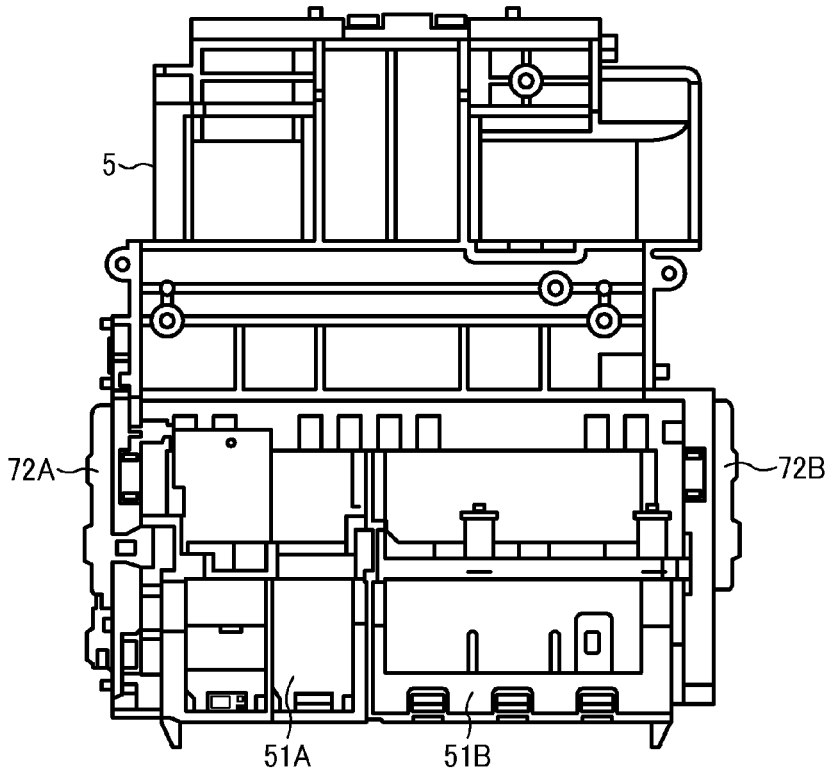
FIG. 5 is a front view of FIG. 4 according to the embodiment of the present disclosure.
Figure 6:
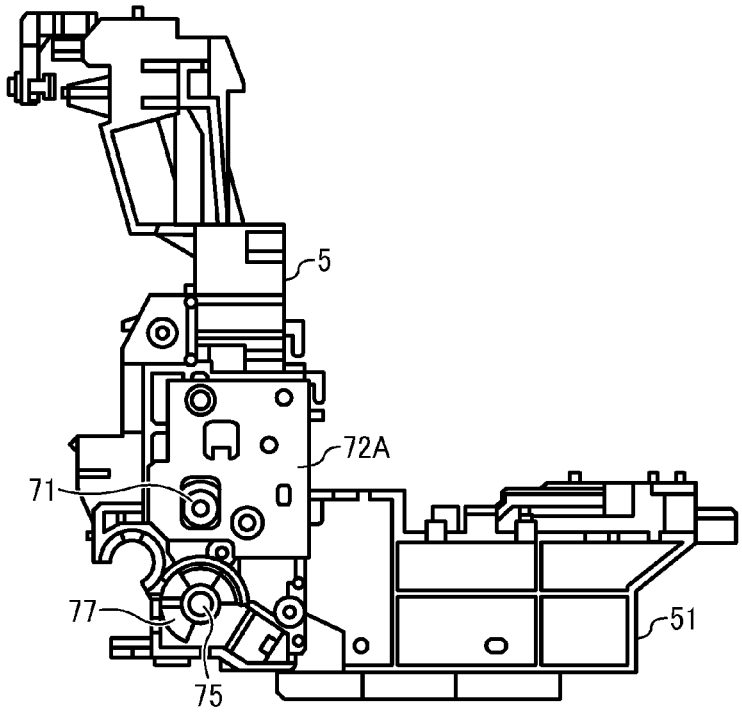
FIG. 6 is a side view of FIG. 4 according to the embodiment of the present disclosure.
Figure 7:
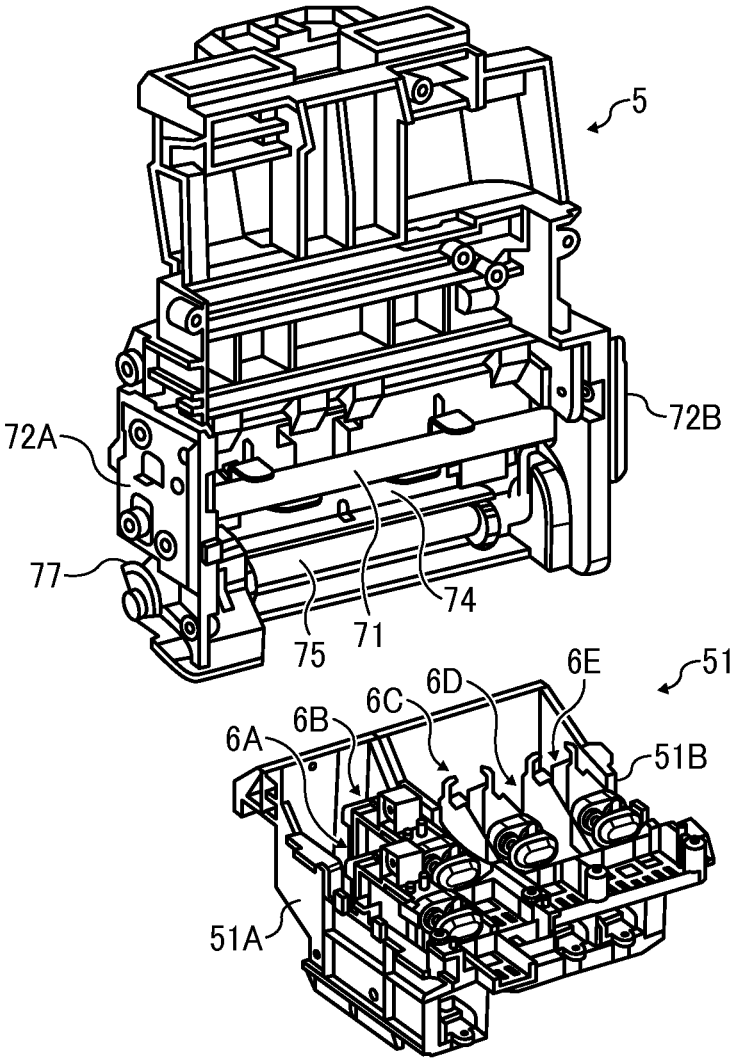
FIG. 7 is a perspective view of the state where the head holders are detached from the carriage according to the embodiment of the present disclosure.
Figure 8:
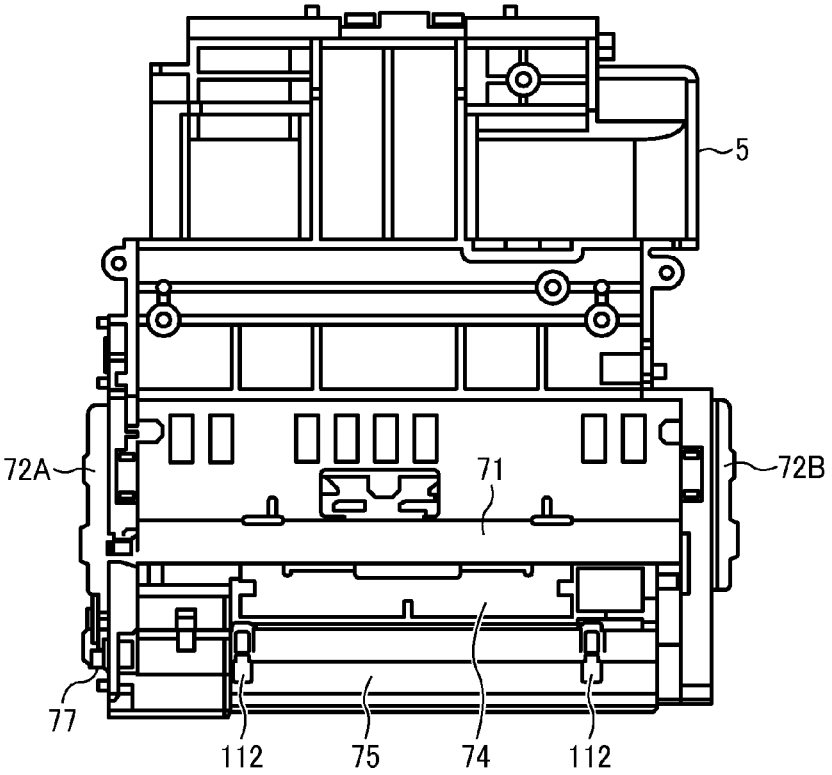
FIG. 8 is a front view of the carriage according to the embodiment of the present disclosure.

Specific examples of the carriage and the head holder will further be described. FIG. 4 is a perspective view of the state where the head holders are mounted to the carriage in a specific mode. FIG. 5 is a front view of FIG. 4. FIG. 6 is a side view of FIG. 4. FIG. 7 is a perspective view of the state where the head holders are detached from the carriage. FIG. 8 is a front view of the carriage. FIG. 7 illustrates the state where the head holders 51 hold the recording heads 6 (6A to 6E) of each color.

The reference shaft 71 is positioned relative to the carriage by adjusting plates 72A and 72B disposed on the both side surfaces of the carriage 5. That is, the adjusting plates 72A and 72B are position adjusters to adjust the position of the reference member (reference shaft 71) relative to the carriage. In addition, a sub-reference shaft 75 as a sub-reference member is disposed at the carriage 5 under the reference shaft 71. The head holders 51 supported by the reference shaft 71 are in contact with the sub-reference shaft 75 and held by the carriage 5.

By deciding the postures of the head holders 51 by the two shafts, that is, the reference shaft 71 and the sub-reference shaft 75, the plurality of head holders 51 can be held in the carriage 5 with high accuracy. In addition, an adjuster is included to adjust the parallelism of the sub-reference shaft 75 with the reference shaft 71. In this embodiment, the adjuster has one end of the sub-reference shaft 75 (left end in FIG. 8) movable in a front-back direction (a direction vertical to FIG. 8, that is, a direction passing through FIG. 8) and an adjusting member (adjusting cum 77) adjusting the position of the one end (left end in FIG. 8) of the movable sub-reference shaft 75.

The adjusting cum 77 as the adjusting member is disposed at the end of the sub-reference shaft 75 at the front and left side. The adjusting cum 77 moves the one end of the sub-reference shaft 75 in the front-back direction to adjust the parallelism of the sub-reference shaft 75 with the reference shaft 71. Accordingly, the parallelism between the reference shaft 71 and the sub-reference shaft 75 can be adjusted on the actual machine. The adjuster to adjust the parallelism of the sub-reference shaft 75 with the reference shaft 71 is not limited to the foregoing one but may be any other appropriate one.

As illustrated in FIG. 8, an interposer 74 is disposed between the reference shaft 71 at the upper side of the carriage 5 and the sub-reference shaft 75 at the lower side of the carriage 5. A plurality of lifting cams 112 is fixed and disposed at the sub-reference shaft 75 such that the lifting cams 112 can be rotated by rotating the sub-reference shaft 75 to lift the interposer 74. The upper surface of the interposer 74 is in abutment with the reference shaft 71. As the interposer 74 is lifted, the reference shaft 71 and the head holders 51 supported by the reference shaft 71 are also raised. When the head holders 51 are raised, the recording heads 6 become higher in position to widen a printing gap.

In the case of printing on a cardboard or wrinkled sheet, the gap between the sheet and the recording heads 6 become narrower than usual and the sheet may touch the recording heads 6. Raising the recording heads 6 prevents such a situation and keeps the constant printing gap even with differences in sheet thickness to provide the printing accuracy.

Figure 9:
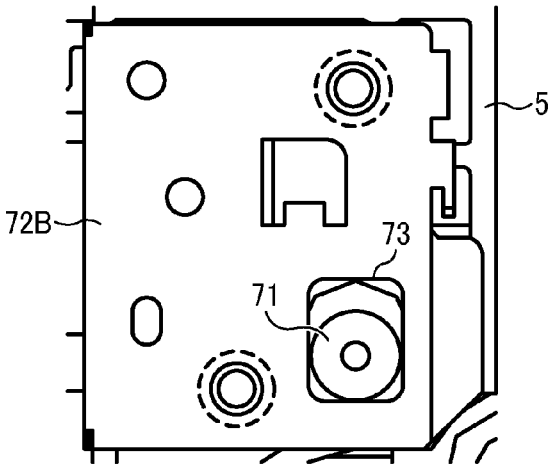
FIG. 9 is a diagram illustrating a positioning part for a reference shaft as seen from the right side of FIG. 8 according to the embodiment of the present disclosure.
Figure 10:
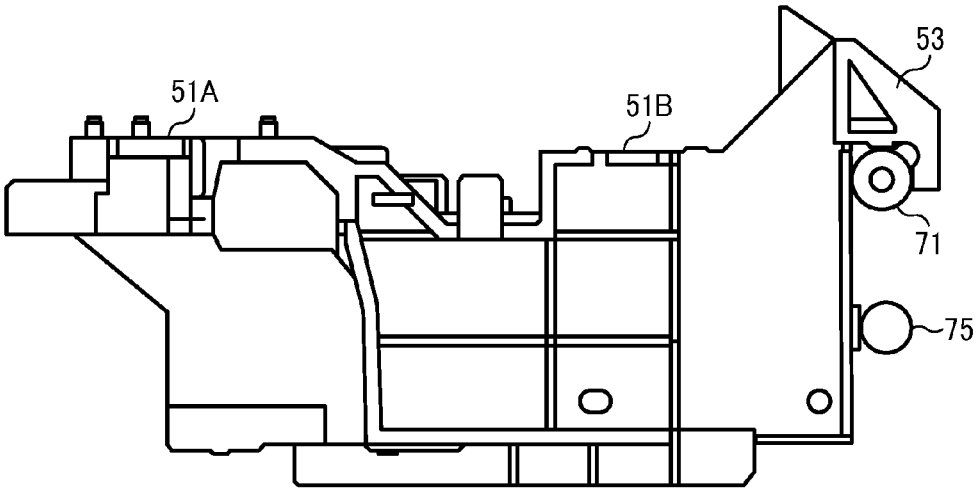
FIG. 10 is a side view of two head holders according to the embodiment of the present disclosure.
Figure 11:
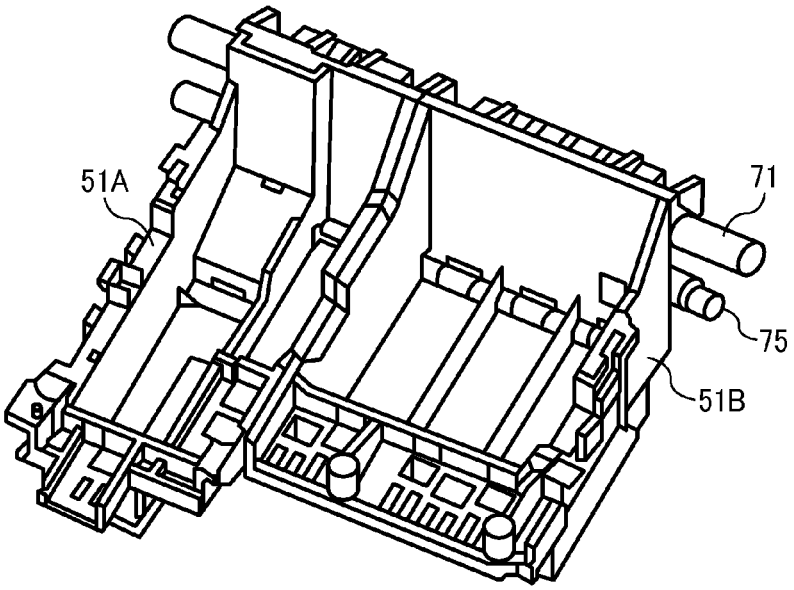
FIG. 11 is a perspective view of the two head holders according to the embodiment of the present disclosure.
Figure 12:
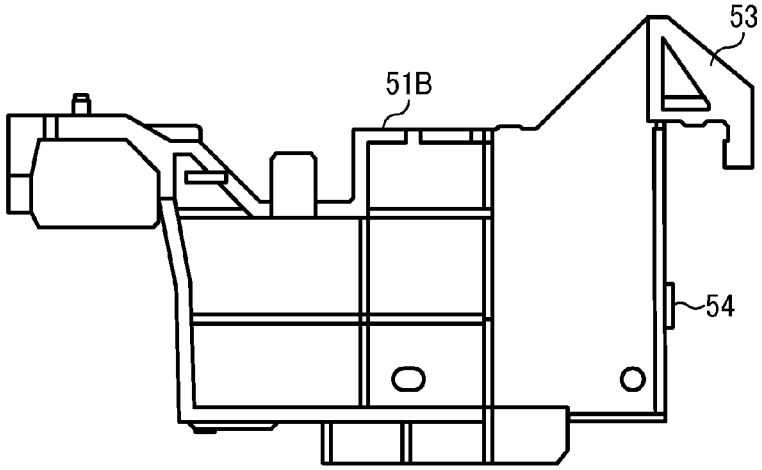
FIG. 12 is a side view of the head holder with a color recording head according to the embodiment of the present disclosure.
Figure 13:
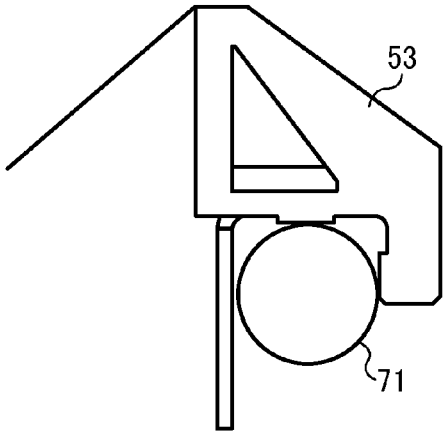
FIG. 13 is an enlarged view of a hook portion in the head holder according to the embodiment of the present disclosure.

FIG. 9 is a diagram illustrating a positioning part for the reference shaft 71 as seen from the right side of FIG. 8. Although FIG. 9 illustrates the side of the adjusting plate 72B, the opposite adjusting plate 72A is the same as the illustrated side. As illustrated in FIG. 9, long cutouts 73 are formed in the adjusting plates 72 (72A and 72B), and the reference shaft 71 fitted into the cutouts 73 is held by the adjusting plates 72 to be capable of being lifted. That is, the reference shaft 71 is movable in up-down directions in FIG. 9 that come close to and away from the recording surface (sheet surface). Accordingly, the head holders 51 (51A and 51B) supported by the reference shaft 71 can come close to and away from the recording surface (sheet surface).

Next, a support structure for the head holders 51 will be described in detail with reference to FIGS. 10 to 14. In the case of using the two head holders 51, the two head holders 51 in the sub-scanning direction are positioned by hitching the hook portions 53 of the head holders 51 to the reference shaft 71. The head holders 51 (51A and 51B) are provided with contact faces 54 (refer to FIG. 12) to be in abutment with the sub-reference shaft 75. The sub-reference shaft 75 and the contact faces 54 are brought into abutment with each other by the moment around the reference shaft 71 generated by the weights of the head holders 51.

A pressing member may be provided to press the head holders 51 against the sub-reference shaft 75. The sub-reference shaft 75 is disposed in parallel to the reference shaft 71, and the two head holders 51 (51A and 51B) are held in the same posture by the two shafts.

Figure 14:
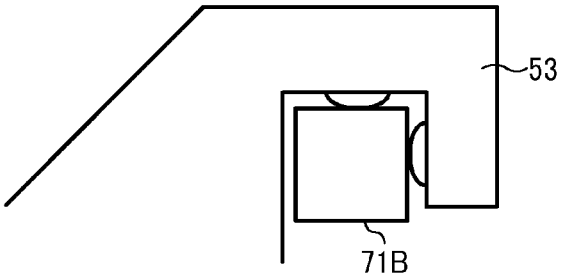
FIG. 14 is an enlarged view of another hook portion in the head holder according to the embodiment of the present disclosure.

As described above, the reference shaft 71 may not be a shaft member (round bar) but may be a polygonal member (bar of polygonal cross section). FIG. 14 illustrates an example in which the polygonal reference shaft 71B is used. In the case where the reference shaft 71B is square as illustrated in FIG. 14, the polygonal reference shaft 71B can be shaped such that the head holders 51 are in point contact with the polygonal reference shaft 71B, thereby ensuring the same accuracy as in the case of using the round shaft.

Figure 15:
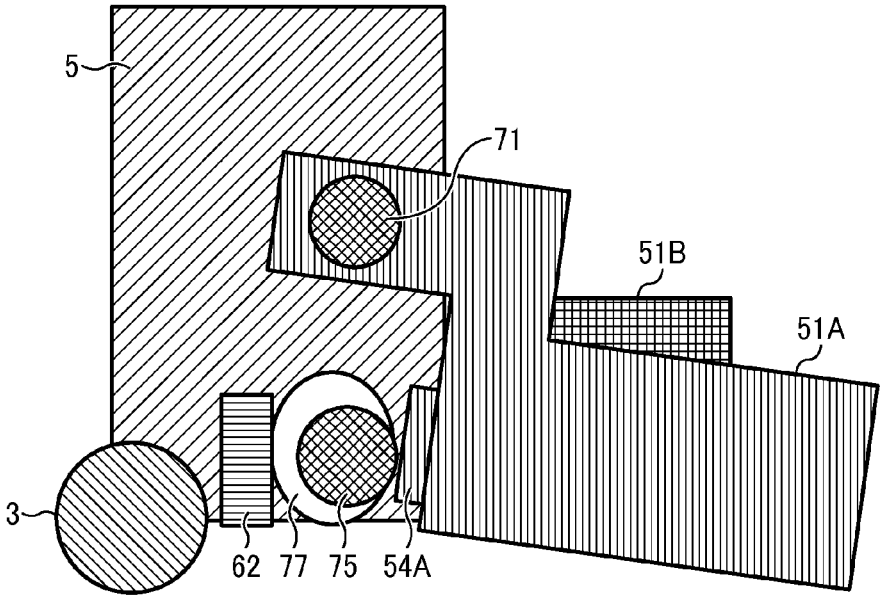
FIG. 15 is a schematic view of a configuration of adjusting the parallel relation between a sub-reference shaft and a reference shaft according to the embodiment of the present disclosure.
Figure 16:
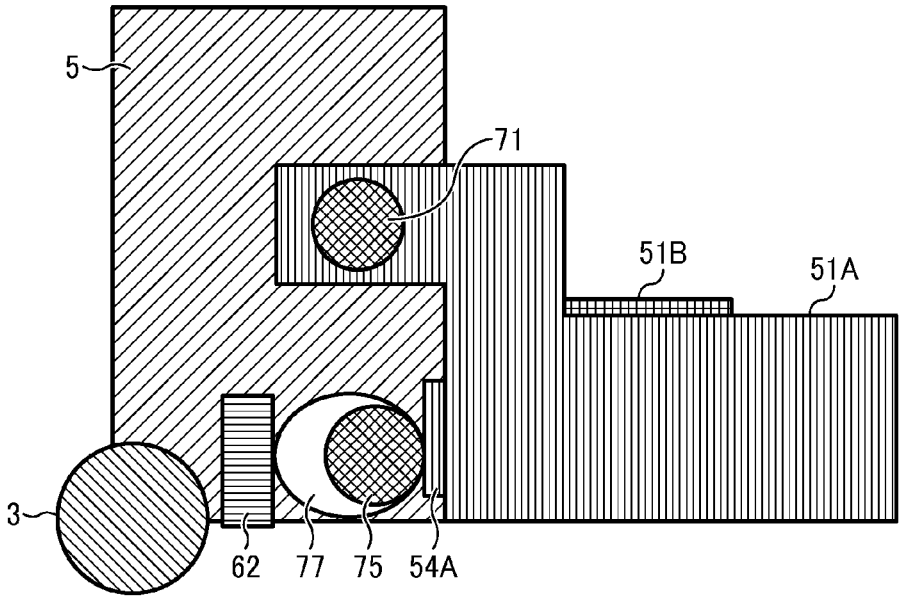
FIG. 16 is a schematic view of the state where the amounts of inclinations of the two head holders are adjusted according to the embodiment of the present disclosure.

FIGS. 15 and 16 are schematic diagrams illustrating a configuration of adjusting the parallelism between the sub-reference shaft 75 and the reference shaft 71. FIGS. 15 and 16 are views as seen from the left side of FIG. 5.

As illustrated in FIGS. 15 and 16, when the two head holders 51A and 51B are different in the amount of inclination due to weight difference and part accuracy, the adjusting cum 77 disposed at the one end of the sub-reference shaft 75 can adjust the parallelism between the sub-reference shaft 75 and the reference shaft 71 and adjust the difference in amount of inclination.

The adjusting cum 77 is in contact with the contact face 62 of the carriage 5 and is disposed to adjust the distance between the one end of the sub-reference shaft 75 and the contact face 62. The adjusting cum 77 is an oval eccentric cam but may have another shape in cross section.

In this embodiment, as described above, the adjusting cum 77 is a member to adjust the parallelism of the sub-reference shaft 75 with the reference shaft 71 and is also a sub-scanning direction position adjuster to adjust the carriage and the sub-reference shaft (sub-reference shaft 75) in the sub-scanning direction by moving the one end of the sub-reference shaft 75 in the front-back direction (right-left direction in FIGS. 15 and 16).

Disposing the adjusting cum 77 makes it possible to adjust the distance between the carriage 5 and the sub-reference shaft (sub-reference shaft 75) in the sub-scanning direction at the one end of the sub-reference shaft 75, and adjust easily the difference in gap between the head holders 51 (51A and 51B) on the actual machine. The head holders 51 can be held in the same manner even when the reference shaft 71 and the sub-reference shaft 75 are reversely positioned (configured).

Figure 17:
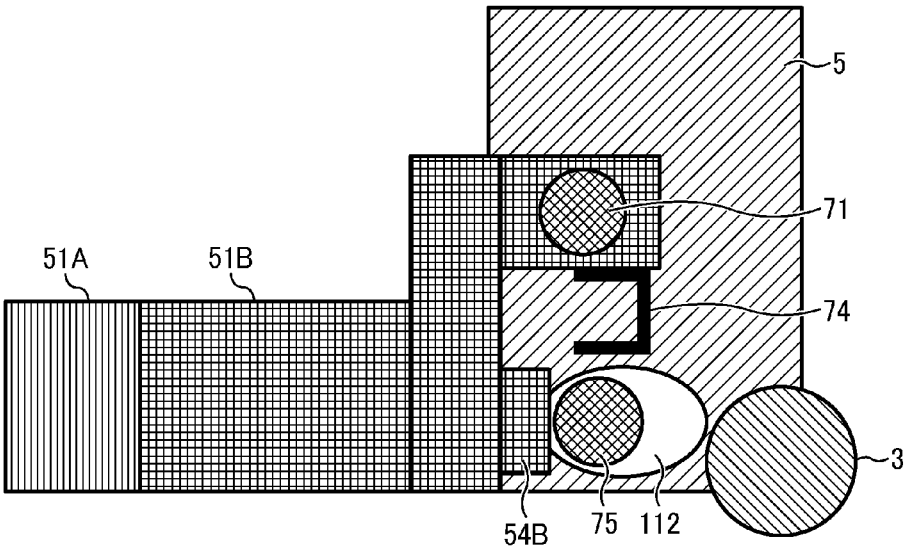
FIG. 17 is a schematic view of a configuration of lifting the head holders by the use of an interposer according to the embodiment of the present disclosure.
Figure 18:
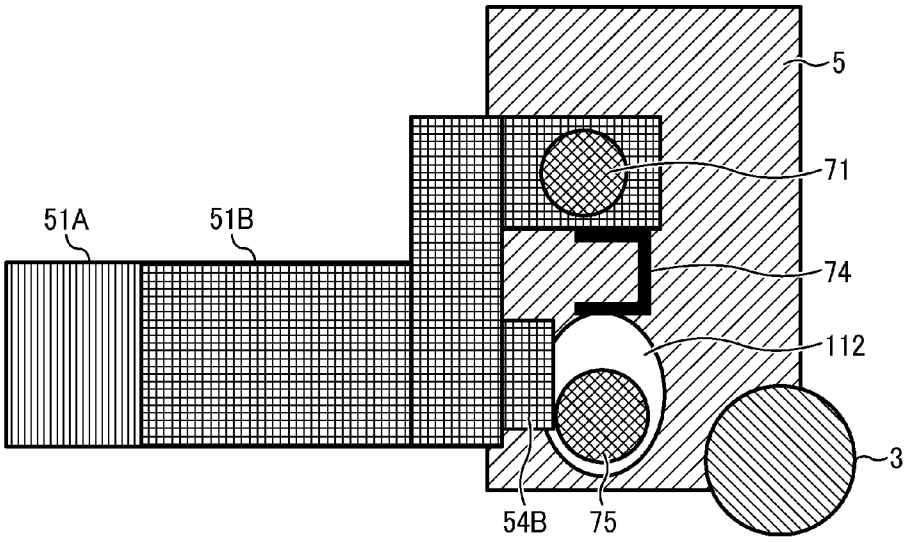
FIG. 18 is a schematic view of the state where the head holders are lifted according to the embodiment of the present disclosure.

Next, a configuration of lifting the head holders 51 will be described with reference to the schematic diagrams of FIGS. 17 to 20. FIGS. 17 to 20 are views as seen from the right side of FIG. 5. As illustrated in FIGS. 17 and 18, an interposer 74 for lifting is disposed between the reference shaft 71 and the sub-reference shaft 75. The interposer 74 is movable in the up-down directions in FIGS. 17 and 18 (that come close to and away from the recording surface, and the reference shaft 71 and the interposer 74 are in abutment with each other. FIG. 21 illustrates a specific example of the interposer 74. In the illustrated example, the interposer 74 has two pressing faces 74*a* and 74*a* at the upper part. The pressing faces 74*a* are brought into abutment with the reference shaft 71. When the lifting cams 112 fixed and disposed at the sub-reference shaft 75 lift the interposer 74, the interposer 74 lifts the reference shaft 71, and the head holders 51 (51A and 51B) are raised to change printing gaps. The lifting cams 112 are oval eccentric cams but may have another shape in cross section.

The contact faces 54A and 54B (collectively referred to as 54) of the head holders 51 relative to the sub-reference shaft 75 (FIGS. 17 to 20 illustrate only the contact face 54B of the holder 51B) are elongated in the height direction. Accordingly, when the head holders 51 are lifted, the reference shaft 71 and the contact faces 54 are kept in contact with each other.

Figure 19:
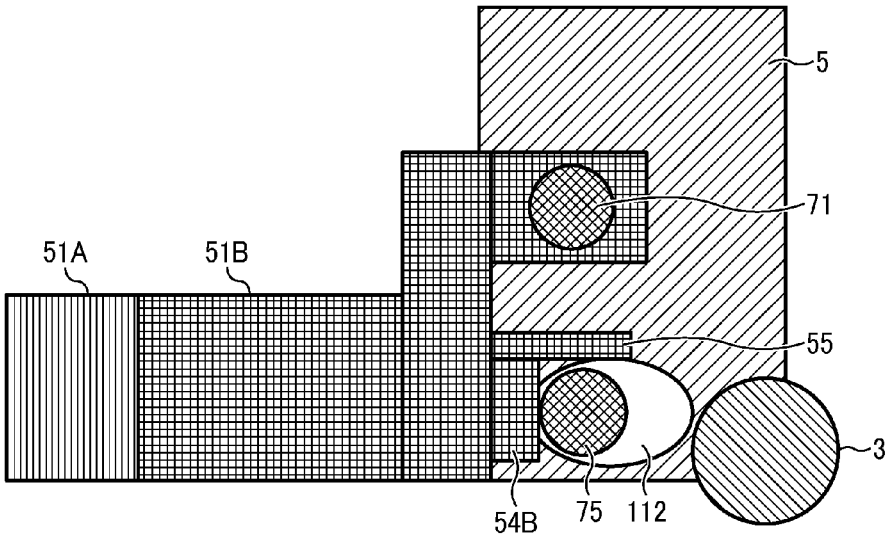
FIG. 19 is a schematic view of a configuration of lifting directly the head holders according to the embodiment of the present disclosure.
Figure 20:
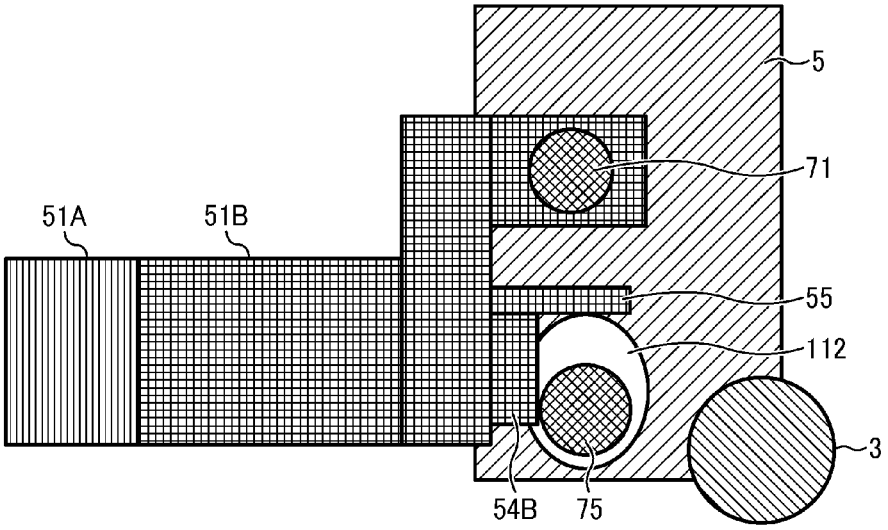
FIG. 20 is a schematic view of the state where the head holders are lifted according to the embodiment of the present disclosure.
Figure 21:
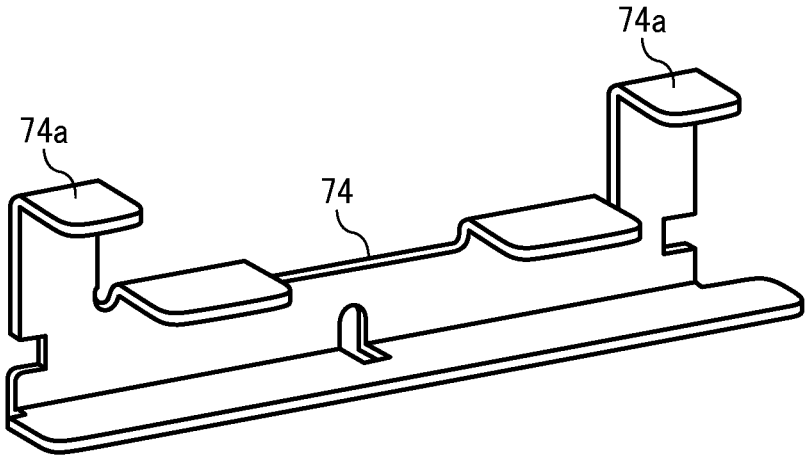
FIG. 21 is a perspective view of a specific form example of the interposer according to the embodiment of the present disclosure.

As in other configuration examples illustrated in FIGS. 19 and 20, each of the head holders 51 has an abutment portion 55 of a shape to allow the lifting cams 112 to abut on the head holders 51 without the use of the interposer 74, so that the lifting cams 112 can lift directly the head holders 51.

In this case, a drive source to rotate the sub-reference shaft 75 and the lifting cams 112 are not included in the carriage 5 but are disposed at the device body. The drive source connects a drive to the carriage 5 at a predetermined position to rotate the sub-reference shaft 75.

As described above, the image forming apparatus according to at least one embodiment of the present disclosure has the reference member, the sub-reference member, and the adjuster to adjust the parallelism of the sub-reference member with the reference member. The head holders detachably supported by the reference member are positioned in contact with the sub-reference member. Accordingly, it is possible to suppress deformation of the member holding the head holders and adjust the positions of the head holders with high accuracy independently from the reference member.

The plurality of head holders can be positioned and held in the carriage with high accuracy, and the positional relation between the two shafts can be adjusted. This allows easy adjustment of the positional relation between the head holders.

The carriage includes the position adjuster to adjust the position of the reference member relative to the carriage. This allows high-accuracy positioning of the reference member relative to the carriage.

The reference member is movable in directions to come close to and away from the recording surface. Supporting the head holders by the reference member allows the head holder to move in the directions to come close to and away from the recording surface to adjust the printing gap.

By moving (lifting) the reference member by the interposer, the head holders can be lifted together with the reference member to keep the positions of the head holders with high accuracy at the time of lifting (when the distance from the recording surface is longer).

According to the configuration of moving (lifting) directly the head holders, the printing gap can be adjusted according to a recording medium. The position adjuster is disposed at the one end of the sub-reference member to adjust the distance between the carriage and the sub-reference member in the sub-scanning direction. Accordingly, the simple configuration allows adjustment of the parallelism between the reference member and the sub-reference member on the actual machine. In the case of using a plurality of head holders, the differences in the amount of inclination between the head holders can be adjusted.

The above-described embodiments of the present disclosure are described with reference to the drawings. However, the present invention are not limited to the above-described embodiments and numerous additional modifications and variations are possible within the scope of the above teachings.

For example, in this disclosure, the term "sheet" used herein is not limited to a sheet of paper and includes anything such as OHP (overhead projector) sheet, cloth sheet, glass sheet, or substrate on which ink or other liquid droplets can be attached. In other words, the term "sheet" is used as a generic term including a recording medium, a recorded medium, a recording sheet, and a recording sheet of paper. The terms "image formation", "recording", "printing", "image recording" and "image printing" are used herein as synonyms for one another. The terms "image formation", "recording", "printing", and "image printing" are used herein as synonyms for one another.

The term "image forming apparatus" refers to an apparatus that discharges liquid on a medium to form an image on the medium. The medium is made of, for example, paper, string, fiber, cloth, leather, metal, plastic, glass, timber, and ceramic. The term "image formation" includes providing not only meaningful images such as characters and figures but meaningless images such as patterns to the medium (in other words, the term "image formation" also includes only causing liquid droplets to land on the medium).

The term "ink" is not limited to "ink" in a narrow sense, unless specified, but is used as a generic term for any types of liquid usable as targets of image formation. For example, the term "ink" includes recording liquid, fixing solution, DNA sample, resist, pattern material, resin, and so on.

The term "image" used herein is not limited to a two-dimensional image and includes, for example, an image applied to a three dimensional object and a three dimensional object itself formed as a three-dimensionally molded image. The term "image forming apparatus" includes both serial-type image forming apparatus and line-type image forming apparatus. The term "image forming apparatus" is not limited to a printer and may be, for example, a copier, a facsimile, a plotter, or a multifunctional periphery having at least one of the foregoing capabilities.

What is claimed is:

1. An image forming apparatus, comprising:

at least one recording head including a plurality of nozzles to discharge droplets;

at least one head holder to hold the at least one recording head;

a carriage to hold the at least one head holder and movable in a main scanning direction;

a reference member provided at the carriage and arranged along the main scanning direction;

a sub-reference member provided at the carriage in separation from the reference member; and an adjuster to adjust parallelism of the sub-reference member to the reference member, the at least one head holder supported by and detachable from the reference member, positioned in contact with the sub-reference member, and held in the carriage.

2. The image forming apparatus according to claim 1, wherein the carriage includes a position adjuster to adjust a position of the reference member relative to the carriage.

3. The image forming apparatus according to claim 2, wherein the reference member is movable in directions to come close to and away from a recording surface, and the at least one head holder supported by the reference member is movable in directions to come close to and away from the recording surface.

4. The image forming apparatus according to claim 3, further comprising:

an interposer disposed between the reference member and the sub-reference member and movable in directions to come close to and away from the recording surface; and a lifting cam mounted on the sub-reference member, to move the interposer.

5. The image forming apparatus according to claim 4, further comprising a sub-scanning direction position adjuster disposed at one end of the sub-reference member, to adjust a distance between the carriage and the sub-reference member in a sub-scanning direction.

6. The image forming apparatus according to claim 5, wherein the sub-scanning direction position adjuster is to adjust the parallelism of the sub-reference member to the reference member.

7. The image forming apparatus according to claim 3, further comprising a lifting cam mounted on the sub-reference member, to move the at least one head holder in directions to come close to and away from the recording surface.

8. The image forming apparatus according to claim 7, further comprising a sub-scanning direction position adjuster disposed at one end of the sub-reference member, to adjust a distance between the carriage and the sub-reference member in a sub-scanning direction.

9. The image forming apparatus according to claim 8, wherein the sub-scanning direction position adjuster is to adjust the parallelism of the sub-reference member to the reference member.

10. The image forming apparatus according to claim 3, further comprising a sub-scanning direction position adjuster disposed at one end of the sub-reference member, to adjust a distance between the carriage and the sub-reference member in a sub-scanning direction.

11. The image forming apparatus according to claim 10, wherein the sub-scanning direction position adjuster is to adjust the parallelism of the sub-reference member to the reference member.

12. The image forming apparatus according to claim 2, further comprising a sub-scanning direction position adjuster disposed at one end of the sub-reference member, to adjust a distance between the carriage and the sub-reference member in a sub-scanning direction.

13. The image forming apparatus according to claim 12, wherein the sub-scanning direction position adjuster is to adjust the parallelism of the sub-reference member to the reference member.

14. The image forming apparatus according to claim 1, wherein the reference member is movable in directions to come close to and away from a recording surface, and the at least one head holder supported by the reference member is movable in directions to come close to and away from the recording surface.

15. The image forming apparatus according to claim 14, further comprising:

an interposer disposed between the reference member and the sub-reference member and movable in directions to come close to and away from the recording surface; and a lifting cam mounted on the sub-reference member, to move the interposer.

16. The image forming apparatus according to claim 14, further comprising a lifting cam mounted on the sub-reference member, to move the at least one head holder in directions to come close to and away from the recording surface.

17. The image forming apparatus according to claim 1, further comprising a sub-scanning direction position adjuster disposed at one end of the sub-reference member, to adjust a distance between the carriage and the sub-reference member in a sub-scanning direction.

18. The image forming apparatus according to claim 17, wherein the sub-scanning direction position adjuster is to adjust the parallelism of the sub-reference member to the reference member.

* * * * *